US007604184B1

(12) United States Patent
Chen

(10) Patent No.: US 7,604,184 B1
(45) Date of Patent: Oct. 20, 2009

(54) ROTATABLE WATER-SPRAYING BAT

(75) Inventor: Sen-Yuan Chen, Hsinchu (TW)

(73) Assignee: OW AE Enterprise Co., Ltd., Hsinchu (TW)

( * ) Notice: Subject to any disclaimer, the term of this patent is extended or adjusted under 35 U.S.C. 154(b) by 0 days.

(21) Appl. No.: 12/164,132

(22) Filed: Jun. 30, 2008

(51) Int. Cl.

| | |
|---|---|
| ***B05B 9/08*** | (2006.01) |
| ***B05B 9/047*** | (2006.01) |
| ***B05B 9/04*** | (2006.01) |
| ***B05B 9/00*** | (2006.01) |
| ***B05B 15/00*** | (2006.01) |
| ***B05B 17/00*** | (2006.01) |
| ***A63H 23/00*** | (2006.01) |
| ***A63B 59/00*** | (2006.01) |

(52) U.S. Cl. ..... 239/289; 239/152; 239/321; 222/79; 446/153; 473/564

(58) Field of Classification Search ..... 239/152, 239/154, 288, 288.3, 289, 319–321, 329, 239/331, 525, 600; 222/79, 386; 446/153, 446/196; 473/564

See application file for complete search history.

(56) References Cited

U.S. PATENT DOCUMENTS

| | | | | |
|---|---|---|---|---|
| 5,009,413 | A * | 4/1991 | Allen | 472/128 |
| 5,992,697 | A * | 11/1999 | James | 222/175 |
| 7,281,642 | B2 * | 10/2007 | Orlowski | 222/79 |
| 2007/0000942 | A1 * | 1/2007 | Wong et al. | 222/79 |
| 2008/0035680 | A1 * | 2/2008 | Orlowski | 222/386 |

* cited by examiner

*Primary Examiner*—Darren W Gorman
(74) *Attorney, Agent, or Firm*—Leong C. Lei

(57) ABSTRACT

A rotatable water-spraying bat is disclosed. The bat comprises a soft material mount, a water storage cylinder and a push pushing-piston. The soft material covers the external of the water storage cylinder, and the inner diameter of the water storage cylinder provides the insertion of the pushing-piston cylinder as one unit. The bat is characterized in that at an open area of the water storage cylinder being provided with two fastening ring is mounted with a recess for the insertion of the corresponding L-shaped fastening plate and is then rotated, the protruded ring urges the recess to be in a fastening position so that the great impact onto the spray bat will not dislocate the spray bat the guiding corner at the front end of the recess allows the protruded ring to be engaged and dislocation is not possible.

1 Claim, 5 Drawing Sheets

ROTATABLE WATER-SPRAYING BAT

BACKGROUND OF THE INVENTION (a) Technical Field of the Invention

The present invention relates to water-spraying bat having a water storage cylinder and a pushing-piston, and in particular, a rotatable water-spraying bat with a secured mounting between the water storage cylinder and the pushing-piston.

(b) Description of the Prior Art

U.S. Pat. No. 7,281,642 discloses a hollow rod body being made to form a water-sprayer, and the sprayer can be of any shapes to enhance and to provide funs in a game using this rod body. The drawback of the rod body is that when a player swings the rod, the external cylinder will dislocate from the body of the rod, which endangers the players.

Accordingly, it is an object of the present invention to provide a rotatable water-spraying bat which mitigates the above drawback.

SUMMARY OF THE INVENTION

The primary purpose of the present invention is to provide a rotatable water-spraying bat having a water storage cylinder comprising a mount, which is a hollow mount, made from a soft material covering the water storage cylinder, wherein the front end of the water storage cylinder is provided with a spraying hole, and an opening area at the rear end of the water storage cylinder is protrudingly mounted with two fastening plates, the front end of the inner ring of the fastening plate provides with recesses, and the fastening plate at the front end of the recess is provided with a guiding corner, and the external of the water storage cylinder body is used for the covering of a soft material; and the pushing-piston is a hollow piston with the front end being mounted with a soft plug for inserting into the internal diameter of the water storage cylinder, the rear end of the cylinder body is a holding section, two L-shaped fastening plates are formed between the connection of the holding section and the water storage cylinder body, and the external diameter of the pushing-piston at the inner end of the L-shaped fastening plate are two protruded rings; thereby the recess at the two fastening plates is provided for the insertion of the corresponding L-shaped fastening plate and is then rotated, the protruded ring urges the recess to be in a fastening position so that the great impact onto the spraying bat will not dislocate the spraying bat as the guiding corner at the front end of the recess allows the protruded ring to be engaged.

Yet still another object of the present invention to provide a rotatable water-spraying bat, wherein at least two sets of water storage cylinder and the fastening plates of the pushing-piston and the L-shaped fastening plate are mounted correspondingly.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
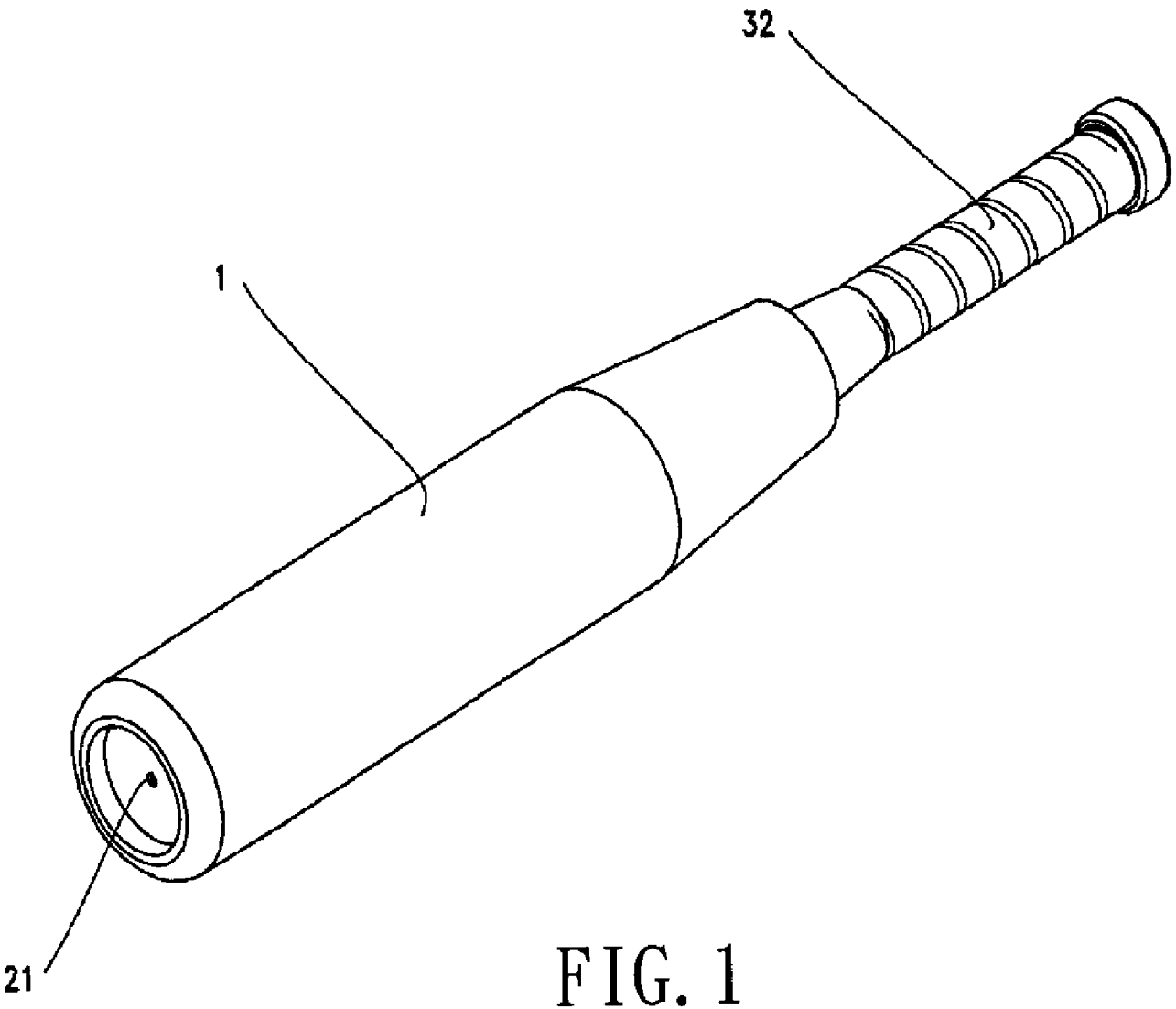
FIG. 1 is a perspective view of a preferred embodiment of the present invention.
Figure 2:
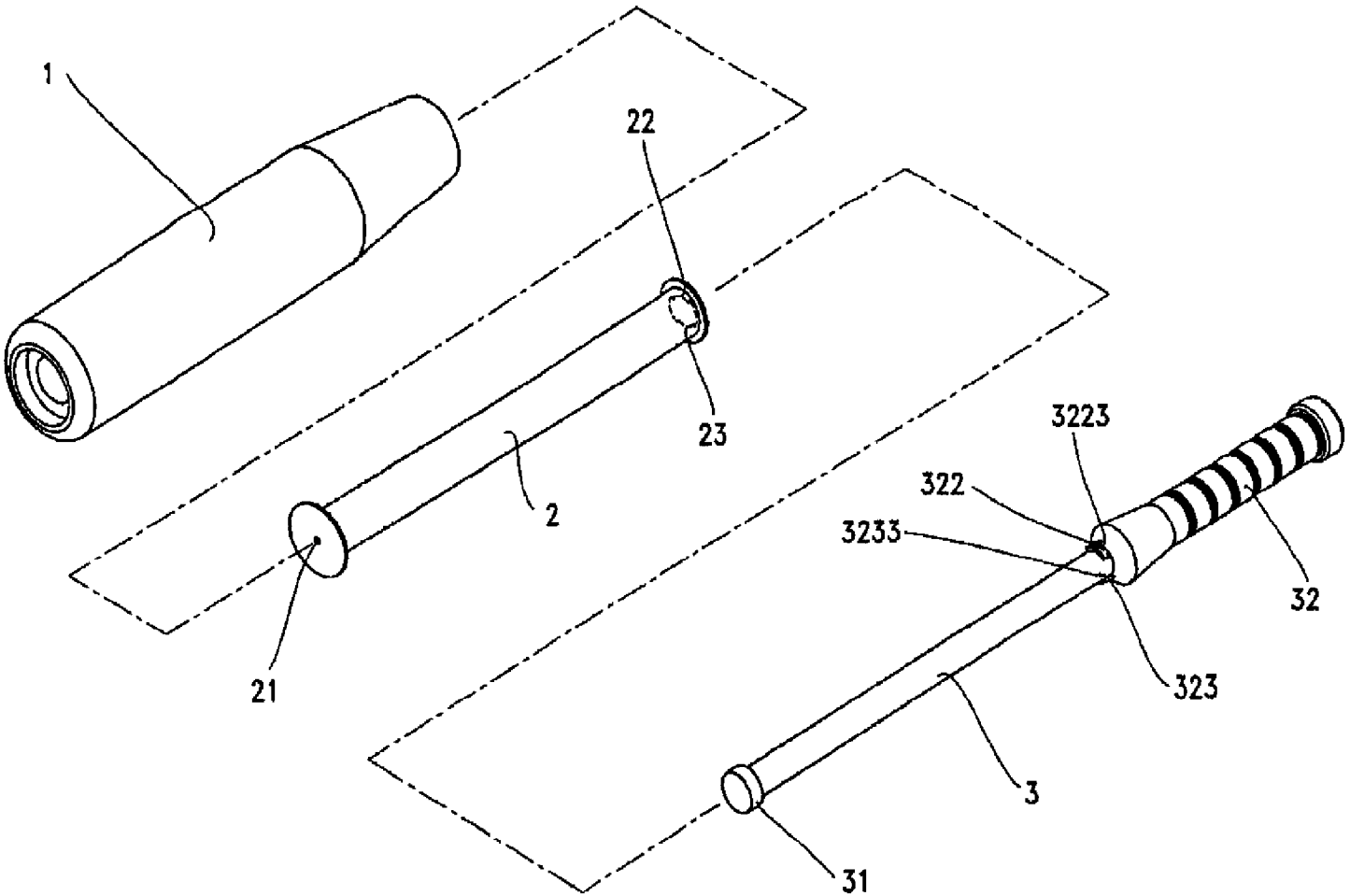
FIG. 2 perspective exploded view of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1 to 5, there is shown a rotatable water-spraying bat comprising a soft material mount 1, a water storage cylinder 2 and a pushing-piston 3. The soft material mount 1 is referring to a hollow mount being made from foamed materials. The water storage cylinder 2 is a tubular body having a front end provided with a spraying hole 21, and having a rear end provided with two fastening plates 22, 23. The front end of the inner ring of the fastening plate is provided with recess 223, 233, and each of the fastening plate is provided with a sliding corner 2233, 2333. The external diameter of the cylinder is provided for the mounting of the soft material mount 1. The pushing-piston 3 is a tubular body having a front end provided with a soft plug 31 for insertion into the inner diameter of the water storage cylinder 2. The rear end of the cylinder body is a holding section 32 and the intersection between the holding section and the cylinder body is protrudingly mounted with two L-shaped fastening plates 322, 323, and the external diameter of the pushing pushing-piston of the L-shaped fastening plate is protrudingly mounted with two protruded rings 3223, 3233.

Figure 3:
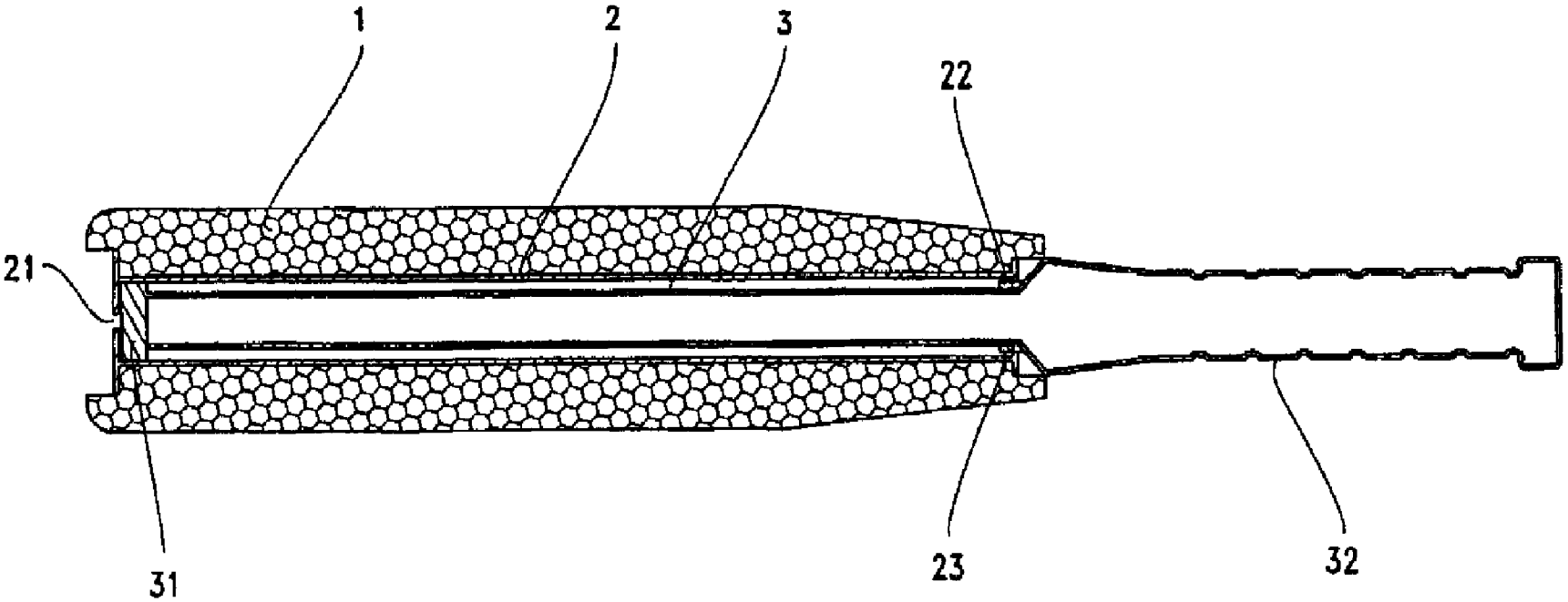
FIG. 3 is a sectional view of the present invention.
Figure 4:
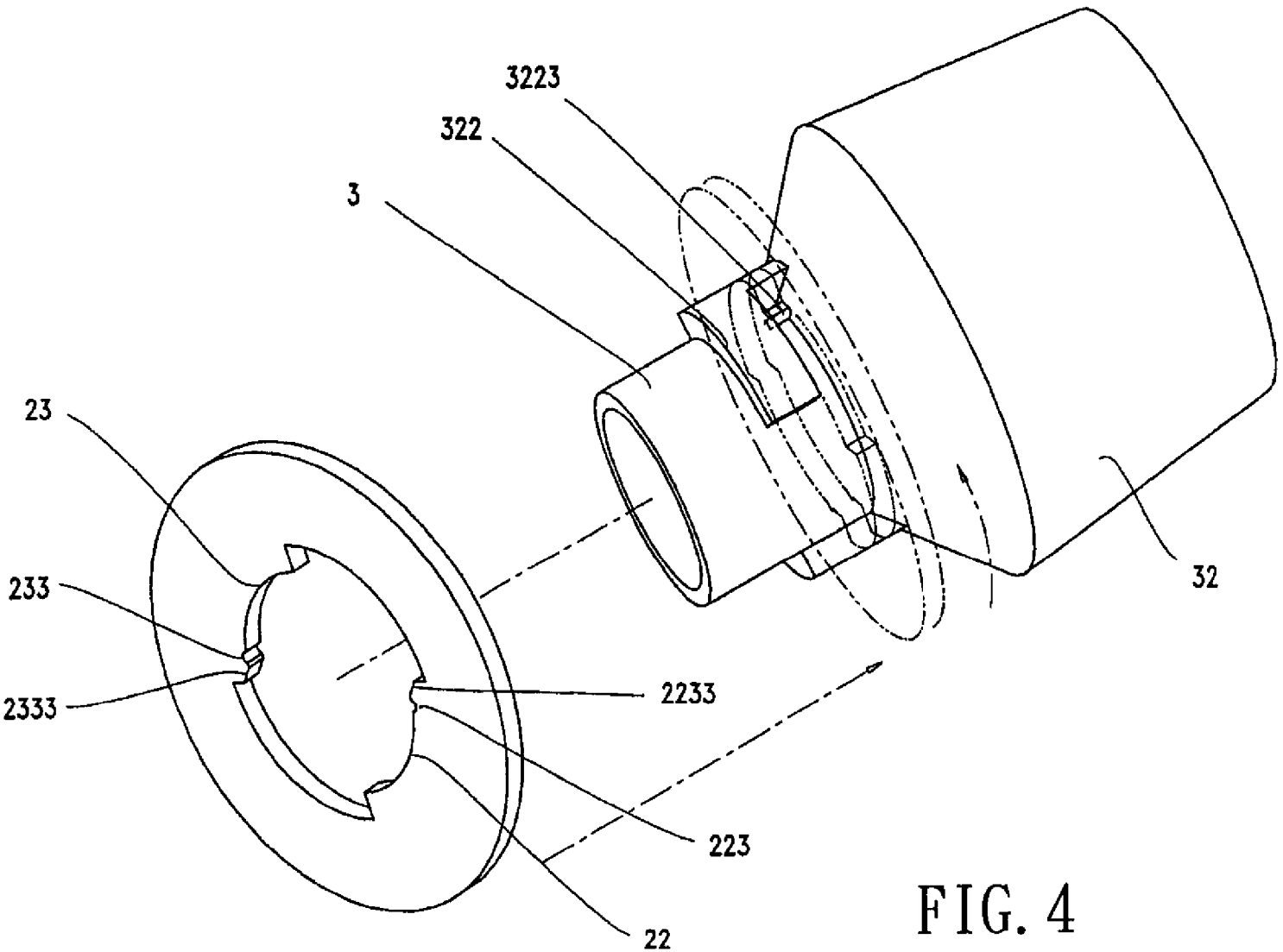
FIG. 4 is a perspective view of the L-shaped fastening plate mounted with the fastening plate of the water storage cylinder in accordance with the present invention.
Figure 5:
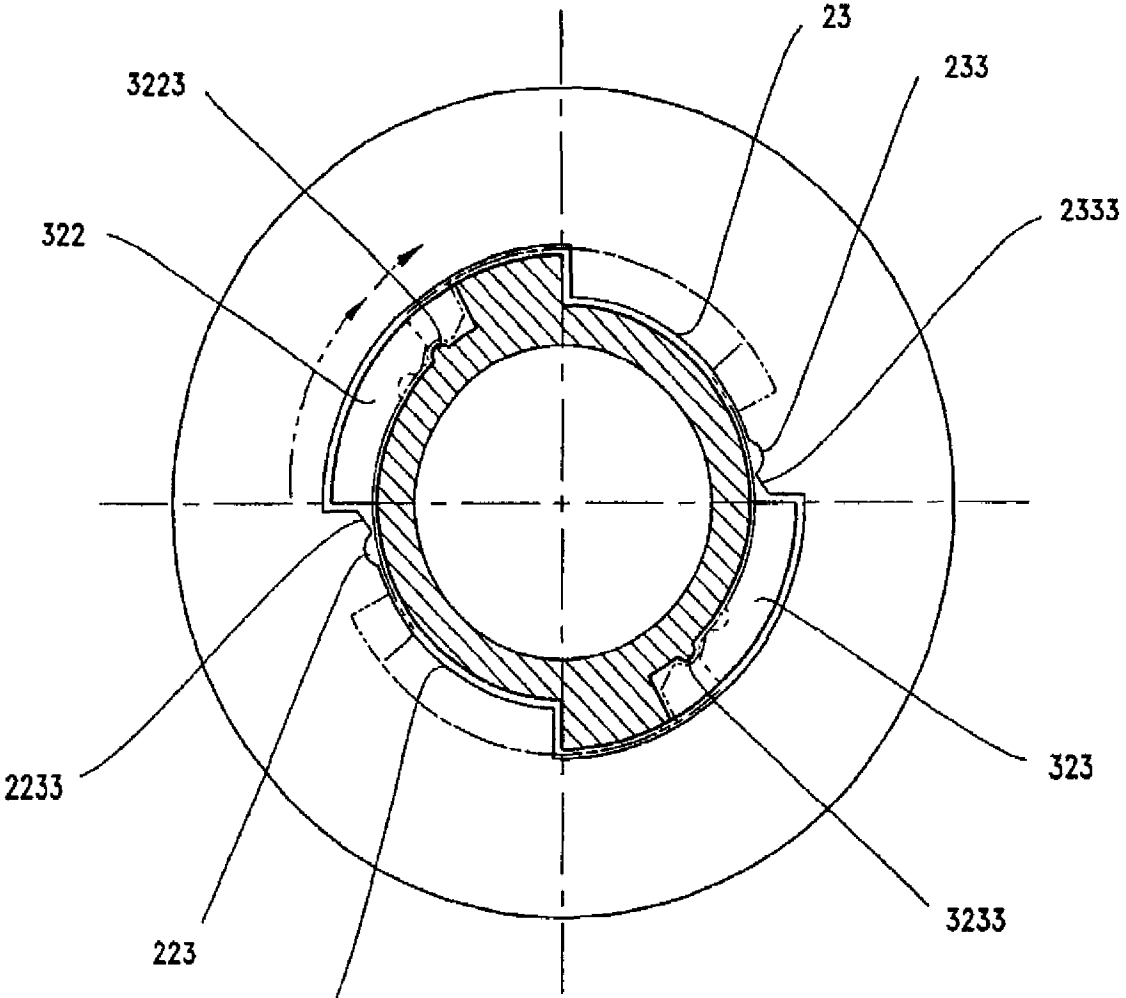
FIG. 5 is a perspective view of the sliding corner engaged with the protruded ring of the present invention.

In implementation, referring to FIGS. 3 to 5, the two fastening plates 22, 23 are each provided with the recess 223, 233 to allow the L-shaped fastening plates 322, 323 of the pushing-piston 3 to be engaged by rotating, and are positioned by the recess formed and the fastening plate with the protruded rings 3223, 3233. This will prevent the dislocation of the parts when someone swings the bat or dislocation due to great shock. The sliding corner 2233, 2333 allow the engagement with the protruded ring such that the water storage cylinder and the pushing pushing-piston can be engaged without dislocation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A rotatable water-spraying bat, comprising:

(a) a water storage cylinder including a cylinder body with an external surface covered by a hollow mount made from a soft material, wherein a front end of the water storage cylinder includes a spraying hole, and at an opening area of a rear end of the water storage cylinder, two fastening plates are protrudingly mounted, wherein a front end of an inner ring of each fastening plate includes a recess, and a front end of each recess includes a guiding corner; and (b) a hollow pushing-piston having a front end and a rear end, the front end having mounted thereon, a soft plug for inserting through the opening area of the water storage cylinder into an internal diameter of the water storage cylinder, and the rear end including a holding section with two L-shaped fastening plates, wherein the two L-shaped fastening plates permit connection of the holding section to the fastening plates of the water storage cylinder when the pushing-piston is fully inserted into the water storage cylinder, and wherein an external diameter of the pushing piston at an inner end of the L-shaped fastening plates includes two protruded rings, whereby each recess of the two fastening plates permit insertion of the corresponding L-shaped fastening plates therein, such that rotation therebetween urges each protruded ring into fastening engagement with a corresponding recess, and such that dislocation of the pushing-piston from the water storage cylinder is prevented in the event of a great impact onto the spray bat.

* * * * *